US005876257A

United States Patent [19]

Lin

[11] Patent Number: 5,876,257

[45] Date of Patent: Mar. 2, 1999

[54] STATOR OF PROPELLING SYSTEM OF SMALL POWERBOAT

[76] Inventor: Yeun-Junn Lin, 5F, No. 23, Lane 10, Tian Bao Street, Taichung, Taiwan

[21] Appl. No.: 925,269

[22] Filed: Sep. 8, 1997

[51] Int. Cl.[6] ..... B63H 11/08

[52] U.S. Cl. ..... 440/38; 440/47

[58] Field of Search ..... 440/38, 40–42, 440/47; 60/221, 222

[56] References Cited

U.S. PATENT DOCUMENTS 3,083,529 4/1963 Hamilton ..... 440/38

5,222,863 6/1993 Jones ..... 440/38

*Primary Examiner*—Ed L. Swinehart

*Attorney, Agent, or Firm*—Browdy and Neimark

[57] ABSTRACT

A powerboat propelling system is composed of an engine, a water tract, a propeller, and a stator. The water tract is provided with a water inlet, a nozzle having a water outlet, and a midsection in which the propeller is mounted. The stator is composed of a frame, an axial portion, and a plurality of stator blades fastened with the frame and the axial portion. The axial portion has a front segment and a rear segment. The front segment and the frame form therebetween a first circular space forming a portion of the water tract, whereas the rear segment and the nozzle form therebetween a second circular space forming a portion of the water tract. The first and the second circular spaces have a cross-sectional area which becomes gradually smaller from one end thereof toward another end thereof contiguous to the nozzle for accelerating the flow of water in the water tract without increasing the length of the stator or nozzle.

1 Claim, 3 Drawing Sheets

STATOR OF PROPELLING SYSTEM OF SMALL POWERBOAT

FIELD OF THE INVENTION

The present invention relates generally to a boat propelling system, and more particularly to a stator of the boat propelling system.

BACKGROUND OF THE INVENTION

The boat propelling system makes use of the impeller to compress water current to generate the backward thrust of water to propel the boat. As shown in FIG. 1, a boat propelling system of the prior art consists of an engine 12 housed in a hull 10, a shaft 13 driven by the engine 12, a water tract 11 housed in the hull 10, a propeller 14 mounted on the shaft 13, and a stator 15 located in the water tract 11 and composed of an axial portion 151, a plurality of stator blades 152, and a circular frame 153 holding the stator blades 152. In operation, the propeller 14 is driven by the shaft 13 to rotate to compress the water in the water tract 11. As water is forced to pass the stator 15, the water is guided by the stator blade 152 to flow in a linear direction before the water is discharged via a nozzle 111 to generate the backward thrust of water to propel the boat hull 10.

In order to enhance the backward thrust of water by the nozzle 111, the interior cross sectional area of the nozzle 111 is progressively reduced so as to accelerate the flow speed of water. According to the Bernoulli equation, an increase in the backward thrust of water can be attained by a gradual reduction in the interior cross-sectional area of the nozzle 111. However, such a nozzle 111 as described above is limited in design in that the water acceleration is often undermined by the inner wall of the nozzle 111 which is shortened, and that the hull 10 must be lengthened to accommodate the lengthened nozzle 111. In other words, an effective improvement in the boat propelling system can not be attained by redesigning the nozzle 111.

SUMMARY OF THE INVENTION

It is therefore the primary objective of the present invention to provide the boat propelling system with an improved stator capable of enhancing the water thrust of the boat propelling system.

It is another objective of the present invention to provide a boat propelling system with a tract capable of effective acceleration of water.

In keeping with the principle of the present invention, the foregoing objectives of the present invention are attained by a stator consisting of an axial portion, a plurality of stator blades, and a circular frame. The axial portion and the stator blades are enclosed by the circular frame such that a circular tract is formed between the inner wall of the circular frame and the outer wall of the axial portion. The circular tract has a cross-sectional area which becomes gradually smaller to bring about an effective water acceleration, which results in an increase in the backward thrust of water.

DETAILED DESCRIPTION OF THE INVENTION

Figure 1:
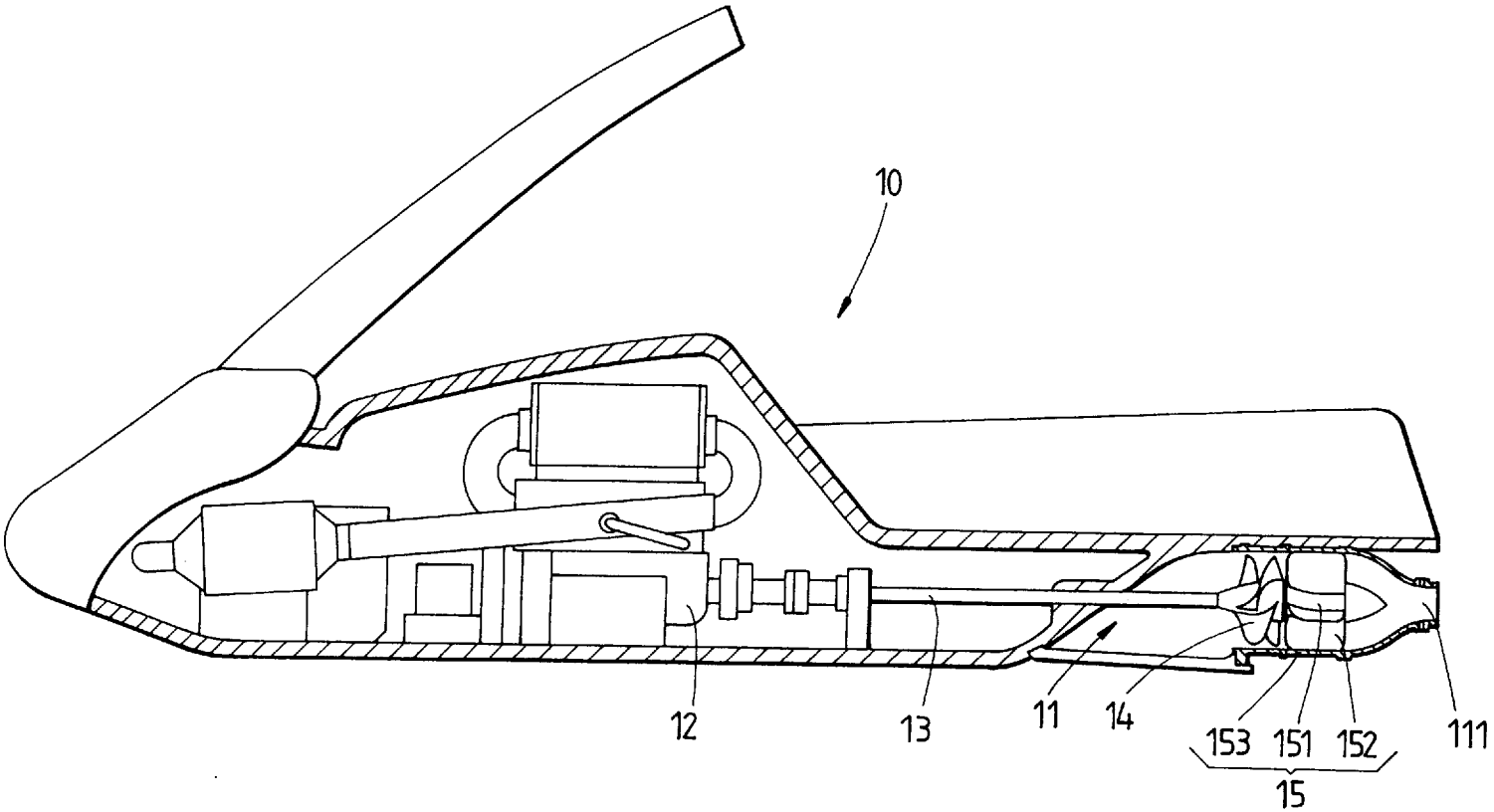
FIG. 1 (PRIOR ART)
FIG. 1 shows a schematic view of a boat propelling system of the prior art.
Figure 2:
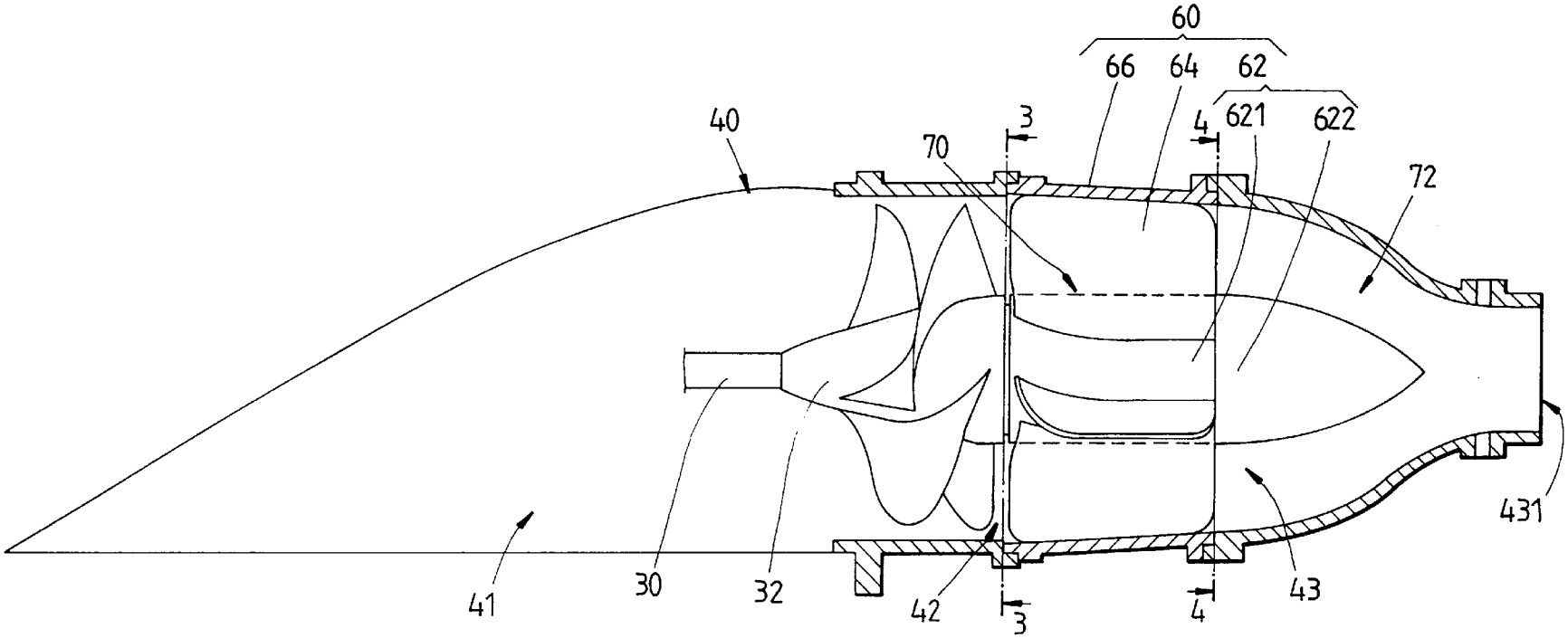
FIG. 2 shows a sectional schematic view of an embodiment of the present invention.
Figure 3:
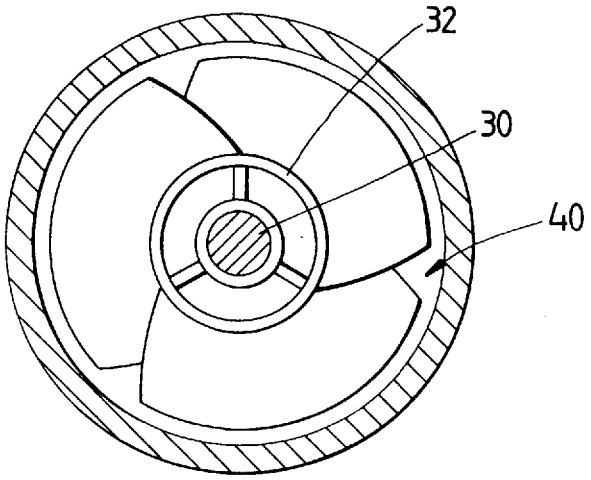
FIG. 3 shows a sectional view of a portion taken along the direction indicated by a line 3—3 as shown in FIG. 2.
Figure 4:
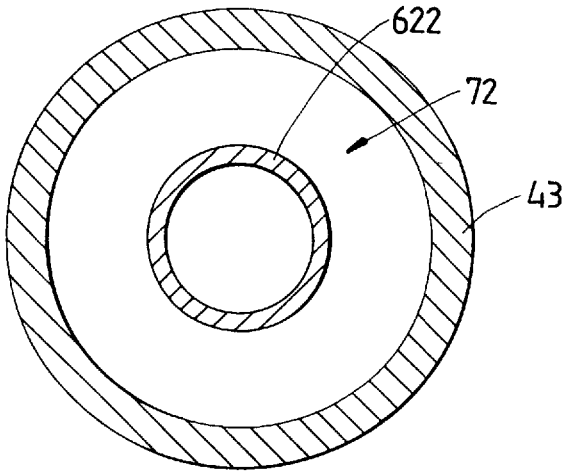
FIG. 4 shows a sectional view of a portion taken along the direction indicated by a line 4—4 as shown in FIG. 2.

As shown in FIGS. 2–4, a boat propelling system of the embodiment of the present invention consists of an engine (not shown in the drawing), a shaft 30 driven by the engine, a propeller 32 mounted on the shaft 30, a water tract 40, and a stator 60.

The water tract 40 is composed of a water inlet 41, a midsection 42, and a nozzle 43 having a water outlet 431. The nozzle 43 is gradually tapered toward the water outlet 431. The shaft 30 is fastened at one end thereof with the engine such that another end of the shaft 30 is extended to reach the interior of the midsection 42 of the water tract 40. The propeller 32 is mounted on the shaft 30. The stator 60 is mounted in the midsection 42 of the water tract 40 such that the stator 60 is located between the propeller 32 and the nozzle 43. As the engine is started, the shaft 30 is driven by the engine to rotate to actuate the propeller 32 to rotate likewise in the water tract 40. The water in the water tract 40 is compressed by the propeller 32 in motion. The flow path of the compressed water is corrected by the stator 60 before the compressed water is discharged via the nozzle 43 to generate the backward thrust to propel the boat.

The subject matter of the present invention is the stator 60, which consists of an axial portion 62, a plurality of stator blades 64, and a frame 66. The axial portion 62 is located in the midsection 42 of the water tract 40 such that the axial portion 62 is coaxial with the propeller 32. The axial portion 62 has a front segment 621 and a rear segment 622. The front segment 621 is of a straight cylindrical construction and is coaxial with the midsection 42 of the water tract 40. The rear segment 622 has an outer diameter which becomes gradually smaller from one end thereof toward another end thereof contiguous to the nozzle 43. As shown in FIG. 2, the stator blades 64 are made integrally with the axial portion 62 such that the stator blades 64 are fastened respectively at their inner end along substantially their entire width with the periphery of the front segment 621 of the axial portion 62, and at a outer end along substantially their entire width thereof with the inner wall of the frame 66 of a conical shape. The frame 66 has an inner diameter which becomes gradually smaller from one end thereof toward another end thereof contiguous to the nozzle 43. The inner wall of the frame 66 and the outer wall of the front segment 621 of the axial portion 62 form therebetween a first circular space 70, which forms a portion of the water tract 40 and has a cross-sectional area that becomes gradually smaller from one end thereof toward another end thereof contiguous to the nozzle 43.

The rear segment 622 of the axial portion 62 is enclosed by the nozzle 43 such that a second circular space 72 is formed therebetween. The second circular space 72 is also a portion of the water tract 40 and is connected with the first circular space 70. The second circular space 72 has a cross-sectional area which becomes gradually smaller from one end thereof toward another end thereof contiguous to the outlet 431 of the nozzle 43.

The acceleration in the flow of water in the water tract 40 is attained by the first circular space 70 and the second circular space 72, without increasing the length of the stator 60 or the nozzle 43.

What is claimed is:

1. A propelling system of a powerboat, said propelling system comprising:

an engine housed in a hull of a powerboat and provided with a shaft fastening therewith such that said is driven by said engine to rotate;

a water tract housed in the hull of the powerboat and provided at one end thereof with a water inlet, and at another end thereof with a nozzle having a water outlet, said water inlet and said water outlet;

a propeller mounted on said shaft such that said propeller is rotatable located in said midsection of said water tract; and a stator fixed in said water tract and composed of a frame, an axial portion, and plurality of stator blades;

wherein said frame of said stator is located between said water inlet and said water outlet of said water tract; said frame having an inner diameter which gradually decreases from said water inlet to said water outlet;

wherein said axial portion of said stator is located in said midsection of said water tract and is coaxial with said propeller, said axial portion having a front segment of a straight tubular construction and a rear segment of a tapered construction, said front segment having an outer wall forming with an inner wall of said frame a first annular space which forms a portion of said water tract, said rear segment being enclosed by said nozzle to form therebetween a second annular space which forms a portion of said water tract, said first annular space having a cross-sectional area which becomes gradually smaller from one end thereof toward another end thereof nearest to said rear segment, said second annular space having a cross-sectional area which becomes gradually smaller from one end thereof nearest to said first annular space towards another end thereof nearest to said water outlet of said nozzle;

wherein said stator blades of said stator are fastened respectively along substantially an entire width of a first end thereof with an outer wall of said axial portion, and along substantially an entire width of a second end thereof with an inner wall of said frame, wherein said frame of said stator has an inner diameter which becomes progressively smaller from one end thereof nearest to said propeller towards another end thereof nearest to said water outlet of said nozzle.

* * * * *